US005742930A

United States Patent [19]

Howitt

[11] Patent Number: 5,742,930

[45] Date of Patent: Apr. 21, 1998

[54] SYSTEM AND METHOD FOR PERFORMING VOICE COMPRESSION

[75] Inventor: Andrew Wilson Howitt, Cambridge, Mass.

[73] Assignee: Voice Compression Technologies, Inc., Boston, Mass.

[21] Appl. No.: 535,586

[22] Filed: Sep. 28, 1995

Related U.S. Application Data

[63] Continuation of Ser. No. 168,815, Dec. 16, 1993, abandoned.

[51] Int. Cl.[6] ..... G10L 3/02

[52] U.S. Cl. ..... 704/502; 704/500; 704/503; 704/214

[58] Field of Search ..... 364/724.15; 381/42.51; 395/2, 2.1, 2.21, 2.28, 2.34–2.39, 2.79, 425; 704/500–504

[56] References Cited

U.S. PATENT DOCUMENTS

| | | | |
|---|---|---|---|
| 4,611,342 | 9/1986 | Miller et al. | 395/2.34 |
| 4,631,746 | 12/1986 | Bergeron et al. | 395/2.26 |
| 4,686,644 | 8/1987 | Renner et al. | 364/724.15 |
| 5,170,490 | 12/1992 | Cannon et al. | 395/2.1 |
| 5,280,532 | 1/1994 | Shenoi et al. | 381/42 |
| 5,285,498 | 2/1994 | Johnston | 395/2.39 |
| 5,353,374 | 10/1994 | Wilson et al. | 395/2.35 |
| 5,353,408 | 10/1994 | Kato et al. | 395/2.75 |
| 5,410,671 | 4/1995 | Elgamal et al. | 395/425 |

OTHER PUBLICATIONS

Sriram et al, "Voice packetization and compression in broadband ATM networks"; IEEE Journal on selected areas in communications, p. 294–304 vol. 9 iss. 3, Apr. 1991.

Intrator et al, "A single chip controller for digital answering machines"; IEEE Transactions on cosumer electronis, pp. 45–48, vol. 39 iss. 1, Feb. 1993.

Bindley, "Voice compression and compatibility and deployment issuies"; IEEE International conference on communications ICC '90, p. 952–954 vol. 3, 16–19 Apr. 1990.

*Primary Examiner*—Tariq R. Hafiz

*Attorney, Agent, or Firm*—Fish & Richardson P.C.

[57] ABSTRACT

Voice compression is performed in multiple stages to increase the overall compression between the incoming analog voice signal and the resulting digitized voice signal over that which would be obtained if only a single stage of compression were to be used. A first type of compression is performed on a voice signal to produce an intermediate signal that is compressed with respect to the voice signal, and a second, different type of compression is performed on the intermediate signal to produce an output signal that is compressed still further. As a result, compression better than 1920 bits per second (and approaching 960 bits per second) are obtained without sacrificing the intelligibility of the subsequently reconstructed analog voice signal. Voice compression is also performed by recognizing redundant portions of said voice signal, such as silence, and replacing such redundant portions with a special code in said compressed signal. Among other advantages, the higher total compression allows speech to be transmitted in far less time than would otherwise be possible, thereby reducing expense.

31 Claims, 4 Drawing Sheets

SYSTEM AND METHOD FOR PERFORMING VOICE COMPRESSION

This is a continuation of application Ser. No. 08/168/815, filed Dec. 16, 1993, now abandoned.

BACKGROUND OF THE INVENTION

This invention relates to voice compression and more particularly to a system and method for performing voice compression in a way which will increase the overall compression between the incoming analog voice signal and the resulting digitized voice signal.

Prerecorded or live human speech is typically digitized and compressed (i.e. the number of bits representing the speech is reduced) to enable the voice signal to be transmitted over a limited bandwidth channel over a relatively low bandwidth communications link (such as the public telephone system) or encrypted. The amount of compression (i.e., the compression ratio) is inversely related to the bit rate of the digitized signal. More highly compressed digitized voice with relatively low bit rates (such as 2400 bits per second, or bps) can be transmitted over relatively lower quality communications links with fewer errors than if less compression (and hence higher bit rates, such as 4800 bps or more) is used.

Several techniques are known for digitizing and compressing voice. One example is LPC-10 (linear predictive coding using ten reflection coefficients of the analog voice signal), which produces compressed digitized voice at 2400 bps in real time (that is, with a fixed, bounded delay with respect to the analog voice signal). LPC-10e is defined in federal standard FED-STD-1015, entitled "Telecommunications: Analog to Digital Conversion of Voice by 2,400 Bit/Second Linear Predictive Coding," which is incorporated herein by reference.

LPC-10 is a "lossy" compression procedure in that some information contained in the analog voice signal is discarded during compression. As a result, the analog voice signal cannot be reconstructed exactly (i.e., completely unchanged) from the digitized signal. The amount of loss is generally slight, however, and thus the reconstructed voice signal is an intelligible reproduction of the original analog voice signal. LPC-10 and other compression procedures provide compression to 2400 bps at best. That is, the compressed digitized speech requires over one million bytes per hour of speech, a substantial amount for either transmission or storage.

SUMMARY OF THE INVENTION

This invention, in general, performs multiple stages of voice compression to increase the overall compression ratio between the incoming analog voice signal and the resulting digitized voice signal over that which would be obtained if only a single stage of compression were to be used. As a result, average compression rates less than 1920 bps (and approaching 960 bps) are obtained without sacrificing the intelligibility of the subsequently reconstructed analog voice signal. Among other advantages, the greater compression allows speech to be transmitted over a channel having a much smaller bandwidth than would otherwise be possible, thereby allowing the compressed signal to be sent over lower quality communications links which will result in a reduction of the transmission expense.

In one general aspect of this concept, a first type of compression is performed on a voice signal to produce an intermediate signal that is compressed with respect to the voice signal, and a second, different type of compression is performed on the intermediate signal to produce an output signal that is compressed still further.

Preferred embodiments include the following features.

The first type of compression is performed so that the intermediate signal is produced in real time with respect to the voice signal, while the second type of compression is performed so that the output signal is delayed with respect to the intermediate signal. The resulting delay between the voice signal and the output signal is more than offset, however, by the increased compression provided by the second compression stage.

The first type of compression is "lossy" in that it causes at least some loss of information contained in the intermediate signal with respect to the voice signal. Preferably, the second type of compression is "lossless" and thus causes substantially no loss of information contained in the output signal with respect to the input signal.

The intermediate signal is stored as a data file prior to performing the second type of compression. The output signal can be stored as a data file, or not. One alternative is to transmit the output signal to a remote location (e.g., over a telephone line via a modem or other suitable device) for decompression and reconstruction of the original voice signal.

The output signal is decompressed (i.e. the number of bits per second representing the speech is increased) by applying the analogs of the compression stages in reverse order. That is, the output signal is decompressed to produce a second intermediate signal that is expanded with respect to the output signal, and then further decompression is performed to produce a second voice signal that is expanded with respect to the second intermediate signal. The compression and decompression steps are performed so that the second voice signal is a recognizable reconstruction of the original voice signal. The first stage of decompression will produce a partially decompressed intermediate signal that is substantially identical to the intermediate signal created during compression.

Preferably, several signal processing techniques are applied to the intermediate signal to enhance the amount of compression contributed by the second type of compression.

For example, the intermediate signal produced by the first type of compression includes a sequence of frames, each of which corresponds to a portion of the voice signal and includes data representative of that portion. Frames that correspond to silent portions of the voice signal (which are almost invariably interspersed with periods of sounds during speech) are detected and replaced in the intermediate signal with a code that indicates silence. The code is smaller in size than the frames. Thus, replacing silent frames with the code compresses the intermediate signal.

Another way in which the compression provided by the second stage is enhanced is to "unhash" the information contained in the frames of the intermediate signal. Voice compression procedures (such as LPC-10) often "hash" or interleave data that represents one voice characteristic (such as amplitude) with data representative of another voice characteristic (e.g., resonance) within each frame. One feature of one embodiment of the invention is to reverse the hashing so that the data for each characteristic appears together in the frame. Thus, sequences of data that are repeated in successive frames can be more easily detected during the second type of compression; often the repeated sequences can be represented once in the output signal, thereby further enhancing the total amount of compression.

In addition, data that does not represent speech sounds are removed from each frame prior to performing the second type of compression, thereby improving the overall compression still further. For example, data installed in each frame by the first type of compression for error control and synchronization are removed.

Yet another technique for augmenting the overall compression is to add a selected number of bits to each frame of the intermediate signal to increase the length thereof to an integer number of bytes. (Obviously, this feature is most useful with compression procedures, such as LPC-10 which produce frames having a non-integer number of bytes—54 bits in the case of LPC-10.) Although the length of each frame is temporarily increased, providing the second type of compression with integer-byte-length frames allows repeated sequences of data in successive frames to be detected relatively easily. Such redundant sequences can usually be represented once in the output signal.

In another aspect of the invention, compression is performed on a voice signal that includes speech interspersed with silence by performing compression to produce a signal that is compressed with respect to the voice signal, detecting at least one portion of the compressed signal that corresponds to a portion of the voice signal that contains substantially only silence, and replacing the silent portion with a code that indicates silence.

Speech often contains relatively large periods of silence (e.g., in the form of pauses between sentences or between words in a sentence). Replacing the silent periods with silence-indicating code (or other periods of repeated sounds with a similar code) dramatically increases compression ratio without degrading the intelligibility of the subsequently reconstructed voice signal. The resulting compressed signal thus requires either less time for transmission or a smaller bandwidth for transmission. If the compressed signal is stored, the required memory space is reduced.

Preferred embodiments include the following features.

The second compression step can be omitted where repetitive periods are replaced by a code. Silent periods are detected by determining that a magnitude of the compressed signal that corresponds to a level of the voice signal is less than a threshold. During reconstruction of the voice signal, the code is detected in the compressed signal and is replaced with a period of silence of a selected length; decompression is then performed to produce a second voice signal that is expanded with respect to the compressed signal and that is a recognizable reconstruction of the voice signal prior to compression.

Other features and advantages of the invention will become apparent from the following detailed description, and from the claims.

DESCRIPTION OF THE PREFERRED EMBODIMENTS

Figure 1:
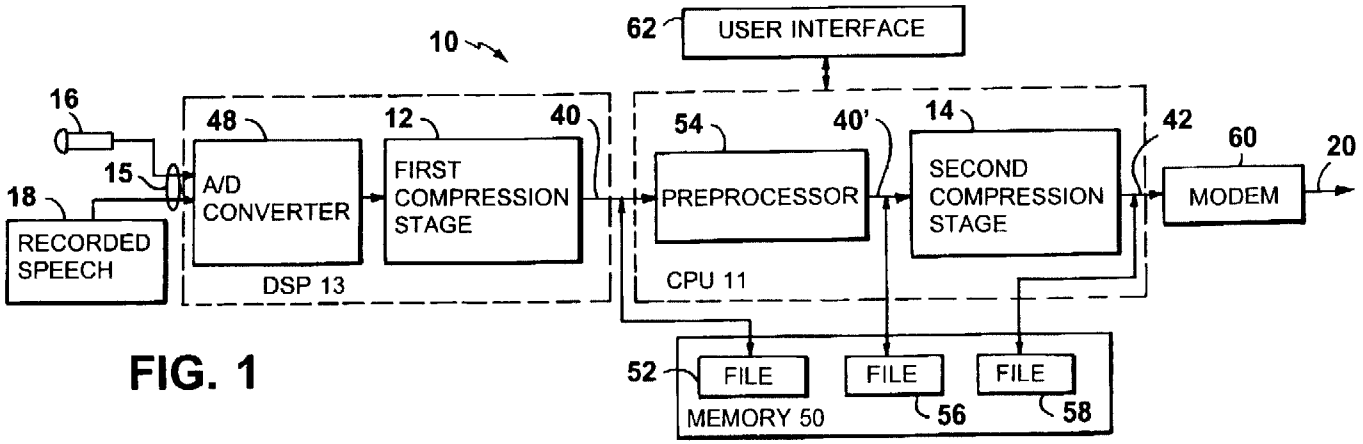
FIG. 1 is a block diagram of a voice compression system that performs multiple stages of compression on a voice signal.
Figure 2:
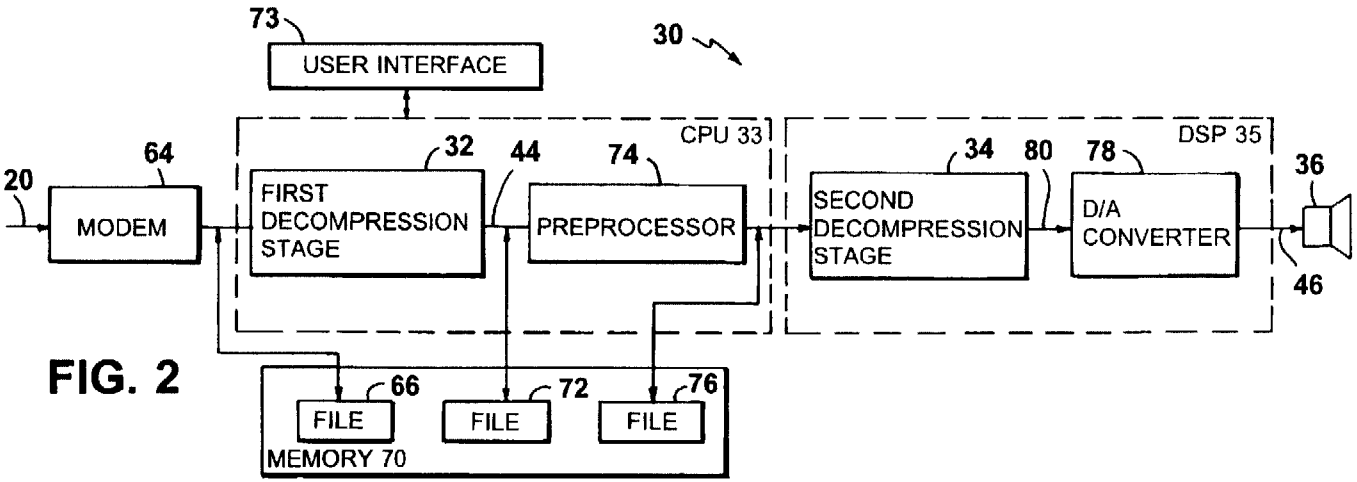
FIG. 2 is a block diagram of a decompression system for reconstructing the voice signal compressed by the system of FIG. 1.

Referring to FIGS. 1 and 2, a voice compression system 10 includes multiple compression stages 12, 14 for successively compressing voice signals 15 applied in either live form (i.e., via microphone 16) or as prerecorded speech (such as from a tape recorder or dictating machine 18). The resulting, compressed voice signals can be stored for subsequent use or may be transmitted over a telephone line 20 or other suitable communication link to a decompression system 30. Multiple decompression stages 32, 34 in decompression system 30 successively decompress the compressed voice signal to reconstruct the original voice signal for playback to a listener via a speaker 36.

Compression stages 12, 14 and decompression stages 32, 34 are discussed in detail below. Briefly, assuming a modem throughput of 24,000 bps total with 19,2000 usable bps, the first compression stage 12 implements the LPC-10 procedure discussed above to perform real-time, lossy compression and produce intermediate voice signals 40 that are compressed to a bit rate of about 2400 bps with respect to applied voice signals 15. Second compression stage 14 implements a different type of compression (which in a preferred embodiment is based Lempel-Ziv lossless coding techniques which are described in Ziv, J. and Lempel, A., "A Universal Algorithm for Sequental Data Compression", IEEE Transactions on Information Theory 23(3):337–343, May 1977 (LZ77) and in Ziv, J. and Lempel, A., "Compression of Individual Sequences via Variable-Rate Coding", IEEE Transactions on Information Theory 24(5):530–536, September 1978 (LZ78) the teachings of which are incorporated herein be reference, to additionally compress intermediate signals 40 and produce output signals 42 that are compressed to between 1920 bps and 960 bps from applied voice signals 15.

After transmission over telephone lines 20, first decompression stage 32 applies essentially the inverse of the compression procedure of stage 14 to reconstruct the signal exactly to produce intermediate voice signals 44 that are decompressed with respect to the transmitted compressed voice signals 42. Second decompression stage 34 implements the reverse of the LPC-10 compression procedure to further decompress intermediate voice signals 44 and reconstruct applied voice signals 15 in real-time as output voice signals 46, which are in turn applied to speaker 36.

As discussed above first compression stage 12 preferably performs compression in real time. That is, intermediate signals 40 are produced without any intermediate storage of data substantially as fast as the voice signals 15 are applied, with only a slight delay that inherently accompanies the signal processing of stage 12. Voice compression system 10 is preferably implemented on a personal computer (PC) or workstation, and uses a digital signal processor (DSP) 13 manufactured by Intellibit Corporation to perform the first compression stage 12. A CPU 11 of the PC performs second compression stage 14. Voice signals 15 are applied to DSP 13 in analog form, and are digitized by an analog-to-digital (A/D) converter 48, which resides on DSP 13, prior to undergoing the first stage compression 12. (A preamplifier, not shown, may be used to boost the level of the voice signal produced by microphone 16 or recording device 18.)

The first compression stage 12 produces intermediate compressed voice signals 40 as an uninterrupted series of frames, the structure of which is described below. The frames, which are of fixed length (54 bits), each represent 22.5 milliseconds of applied voice signal 15. The frames that comprise intermediate compressed voice signals 40 are stored in memory 50 as a data file 52. This is done to facilitate subsequent processing of the voice signals, which may not be performed in real time. Because data file 52 is somewhat large (and because multiple data files 52 are typically stored for subsequent additional compression and transmission), the disk storage of the PC is used for memory 50. (Of course, random access memory, if sufficient in size, may be used instead.)

The frames of intermediate signal 40 are produced in real time with respect to analog signal 15. That is, first compression stage 12 generates the frames substantially as fast as analog signal 15 is applied to A/D converter 48. Some of the information in analog signal 15 (or more precisely, in the digitized version of analog signal 15 produced by A/D converter 48) is discarded by first stage 12 during the compression procedure. This is an inherent result of LPC-10 and other real-time speech compression procedures that compress a speech signal so that it can be transmitted over a limited bandwidth channel and is explained below. As a result, analog voice signal 15 cannot be reconstructed exactly from intermediate signal 40. The amount of loss is insufficient, however, to interfere with the intelligibility of the reconstructed voice signal.

A preprocessor 54 implemented by CPU 11 modifies data file 52 in several ways, all of which are discussed in detail below, to prepare data file 54 for efficient compression by second stage 14. The steps taken by preprocessor 54 are discussed in detail below. Briefly, however, preprocessor 54:

(1) "pads" the frame so that each have an integer-byte length (e.g., 56 bits or 7 (8-bit) bytes);

(2) reverses "hashing" of the data in each frame that is an inherent part of the LPC-10 compression process;

(3) removes control information (such as error control and synchronization bits) that are placed in each frame during LPC-10 compression; and (4) detects frames that correspond to silent portions of voice signal 15 and replaces each such frame with a small (e.g., 1 byte) code that uniquely represents silence.

The modified compressed voice signals 40' produced by preprocessor 54 are stored as a data file 56 in memory 50. It will be appreciated from the above steps that in many cases data file 56 will be smaller in size than, and thus compressed with respect to, data file 52.

Second stage 14 of compression is performed by CPU 11 using by any suitable data compression technique. In the preferred embodiment, the data compression technique uses the LZ78 dictionary encoding algorithm for compressing digital data files. An example of a software product which implements these techniques is PKZIP which is distributed by PKWARE, Inc. of Brown Deer, Wis. The output signal 42 produced by second stage 14 is a highly compressed version of applied voice signal 15. We have found that the successive application of the different types 12, 14 of compression and the intermediate preprocessing 54 cooperate to provide a total compression that exceeds 1920 bps in all cases and in some cases approaches 960 bps. That is, voice signals 15 that are an hour in length (such as would be produced, e.g., by an hour's worth of dictation on a dictation machine or the like) are compressed into a form 42 that can be transmitted over telephone lines 20 in as little as 3 minutes. Moreover, significantly less memory space is needed to store data file 58 than would be required for the digitized voice signal produced by A/D converter 24.

As discussed above, the second compression stage 14 may not operate in real time. If it does not operate in real time, data file 58 is written into memory 50 slower than data file 52 is read from memory 50 by preprocessor 54. Second compression stage 14 does, however, operate losslessly. That is, second stage 14 does not discard any information contained in data file 56 during the compression process. As a result, the information in data file 56 can be, and is, reconstructed exactly by decompression of data file 58.

A modem 60 processes data file 58 and transmits it over telephone lines 20 in the same manner in which modem 60 acts on typical computer data files. In a preferred embodiment, modem 60 is manufactured by Codex Corporation of Canton, Mass. (model no. 3260) and implements the V.42 bis or V.fast standard.

Decompression system 30 is implemented on the same type of PC used for compression system 10. Thus, a modem 64 (also, preferably a Codex 3260) receives the compressed voice signal from telephone line 20 and stores it as a data file 66 in a memory 70 (which is disk storage or RAM, depending upon the storage capacity of the PC). CPU 33 implements decompression techniques to perform first stage decompression 32, which "undoes" the compression introduced by second compression stage 14, and the resulting intermediate voice signal 44 is expanded in time with respect to compressed voice signal 42. In the preferred embodiment, the decompression techniques must be based on the LZ78 dictionary encoding algorithm, and a suitable decompression software package is PKUNZIP which is also distributed by PKWARE, Inc. intermediate voice signal 44 is stored as a data file 72 in memory 70 that is somewhat larger in size than data file 66.

The first decompression stage 32 may not operate in real time. If it does not operate in real time, data file 72 is not written into memory 70 as fast as data file 66 is read from memory 70. First decompression stage 32 does operate losslessly, however. Thus, no information in data file 66 is discarded to create intermediate voice signal 44 and data file 72.

CPU 33 implements preprocessing 74 on data file 72 to essentially reverse the four steps discussed above that are performed by preprocessor 54. Thus, preprocessor 74:

(1) detects the silence-indicating codes in data file 72 and replaces them with frames of predetermined length (7 (8-bit) bytes or 56 bits) that correspond to silent portions of the voice signal 15;

(2) replaces the control information (such as error control and synchronization bits) in each frame for use during LPC-10 decompression;

(3) re-"hashes" the data in each frame so that each frame can be properly decompressed by the LPC-10 process; and (4) removes the "pad" bits from each to return the frames to the 54 bit length expected by second decompression stage 34.

The resulting data file 76 is stored in memory 70.

Second decompression stage 34 and a digital-to-analog (D/A) converter 78 are implemented on an Intellibit DSP 35. Second decompression stage 34 decompresses data file 76 according to the LPC-10 standard and operates in real time to produce a digitized voice signal 80 that is expanded with respect to intermediate voice signal 44 and data file 76. That is, digitized voice signal 80 is produced substantially as fast as data file 76 is read from memory 70. The reconstructed voice signal 46 is produced by D/A converter 78 based on digitized voice signal 80. (An amplifier which is typically used to boost analog voice signal 46 is not shown.)

Figure 3:
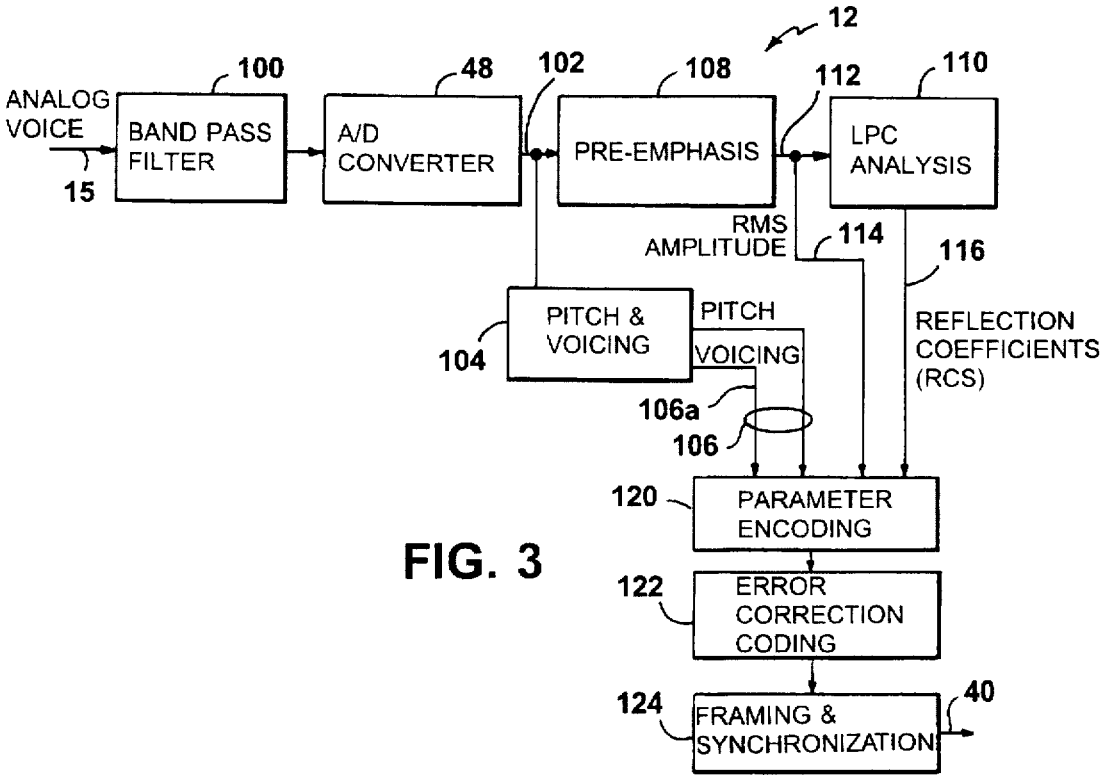
FIG. 3 is a functional block diagram of the first compression stage of FIG. 1.

Referring to FIG. 3, first compression stage 12 is shown in block diagram form. A/D converter 48 (also shown in FIG. 1) performs pulse code modulation on analog voice signal 15 (after the speech has been filtered by bandpass filter 100 to remove noise) to produce a digitized voice signal 102 that has a bit rate of 128,000 bits per second (b/s). Although digitized voice signal 102 is a continuous digital bit stream, first compression stage 12 analyzes digitized voice signal 102 in fixed length segments that can be thought of as input frames. Each input frame represents 22.5 milliseconds of digitized voice signal 102. There are no boundaries or gaps between the input frames. As discussed below, first compression stage 12 produces intermediate compressed signal 40 as a continuous series of 54 bit output frames that have a bit rate of 2400 bps.

Pitch and voicing analysis 104 is performed on each input frame of digitized voice signal 102 to determine whether the sounds in the portion of analog voice signal 15 that correspond to that frame are "voiced" or "unvoiced." The primary difference between these types of sounds is that voiced sounds (which emanate from the vocal chords and other regions of the human vocal track) have pitch, while unvoiced sounds (which are sounds of turbulence produced by jets of air made by the mouth during elocution) do not. Examples of voiced sounds include the sounds made by pronouncing vowels; unvoiced sounds are typically (but not always) associated with consonant sounds (such as the pronunciation of the letter "t").

Pitch and voicing analysis 104 generates, for each input frame, a one byte (8 bit) word 106 which indicates whether the frame is voiced **106*a* and the pitch 106*b* of voiced frames. The voicing indication 106*a* is a single bit of word 106, and is set to a logic "1" if the frame is voiced. The remaining seven bits 106*b* are encoded according to the LPC-10 standard into one of sixty possible pitch values that corresponds to the pitch frequency (between 51 Hz and 400 Hz) of the voiced frame. If the frame is unvoiced, by definition it has no pitch, and all bits 106*a*, 106*b*** are assigned a value of logic "0."

Pre-emphasis 108 is performed on digitized voice signal 102 to provide immunity to noise by preventing spectral modification of the signal 102. The RMS (root mean square) amplitude 114 of the preemphasized voice signal 112 is also determined. LPC (linear predictive coding) analysis 110 is performed on the preemphasized digitized voice signal 112 to determine up to ten reflection coefficients (RCs) possessed by the portion of analog voice signal 15 corresponding to the input frame. Each RC represents a resonance frequency of the voice signal. According to the LPC-10 standard, the full complement of ten reflection coefficients [(RC(1)–RC(10)] are produced for voiced frames; unvoiced frames (which have fewer resonances) cause only four reflection coefficients [(RC(1)–RC(4)] to be generated.

Pitch and voicing word 106, RMS amplitude 114, and reflection coefficients 116 are applied to a parameter encoder 120, which codes this information into data for the 54 bit output frame. The number of bits assigned to each parameter is shown in Table I below:

| | Voiced | Nonvoiced |
|---|---|---|
| Pitch & Voicing | 7 | 7 |
| RMS Amplitude | 5 | 5 |
| RC(1) | 5 | 5 |
| RC(2) | 5 | 5 |
| RC(3) | 5 | 5 |
| RC(4) | 5 | 5 |
| RC(5) | 4 | |
| RC(6) | 4 | |
| RC(7) | 4 | |
| RC(8) | 4 | |
| RC(9) | 3 | |
| RC(10) | 2 | |
| Error Control | | 20 |
| Synchronization | 1 | 1 |
| Unused | | 1 |
| Total | 54 | 54 |

As can readily be appreciated, some parameters (such as pitch and voicing, RMS amplitude, and reflection coefficients 1–4) are included in every output frame, voiced or unvoiced. Unvoiced frames are not allocated bits for reflection coefficients 5–10. Note that 20 bits are set aside in unvoiced frames for error control information, which is inserted downstream, as discussed below, and one bit is unused in each unvoiced output frame. That is, approximately 40% of the length of every unvoiced frame contains error control information, rather than data that describes voice sounds. Both voiced and unvoiced output frames contain one bit for synchronization information (described below).

The 20 bits of error control information are added to unvoiced frames by an error control encoder 122. The error control bits are generated from the four most significant bits of the RMS amplitude code and reflection coefficients RC(1)–RC(4), according to the LPC-10 standard.

Finally, the output frame is passed to framing and synchronization function 124. Synchronization between output frames is maintained by toggling the single synchronization bit allocated to each frame between logic "0" and logic "1" for successive frames. To guard against loss of voice information in case one or more bits of the output frame are lost during transmission, framing and synchronization function 124 "hashes" the bits of the pitch and voicing, RMS amplitude, and RC codes within each output frame as shown in Table II below:

| Bit | Voiced | Nonvoiced | Bit | Voiced | Nonvoiced | Bit | Voiced | Nonvoiced |
|---|---|---|---|---|---|---|---|---|
| 1 | RC(1)-0 | RC(1)-0 | 19 | RC(3)-3 | RC(3)-3 | 37 | RC(8)-1 | R-6* |
| 2 | RC(2)-0 | RC(2)-0 | 20 | RC(4)-2 | RC(4)-2 | 38 | RC(5)-1 | RC(1)-6* |
| 3 | RC(3)-0 | RC(3)-0 | 21 | R-3 | R-3 | 39 | RC(6)-1 | RC(2)-6* |
| 4 | P-0 | P-0 | 22 | RC(1)-4 | RC(1)-4 | 40 | RC(7)-2 | RC(3)-7* |
| 5 | R-0 | R-0 | 23 | RC(2)-3 | RC(2)-3 | 41 | RC(9)-0 | RC(4)-6* |
| 6 | RC(1)-1 | RC(1)-1 | 24 | RC(3)-4 | RC(3)-4 | 42 | P-5 | P-5 |
| 7 | RC(2)-1 | RC(2)-1 | 25 | RC(4)-3 | RC(4)-3 | 43 | RC(5)-2 | RC(1)-7* |
| 8 | RC(3)-1 | RC(3)-1 | 26 | R-4 | R-4 | 44 | RC(6)-2 | RC(2)-7* |

-continued

| Bit | Voiced | Nonvoiced | Bit | Voiced | Nonvoiced | Bit | Voiced | Nonvoiced |
|---|---|---|---|---|---|---|---|---|
| 9 | P-1 | P-1 | 27 | P-3 | P-3 | 45 | RC(10)-1 | Unused |
| 10 | R-1 | R-1 | 28 | RC(2)-4 | RC(2)-4 | 46 | RC(8)-2 | R-7* |
| 11 | RC(1)-2 | RC(1)-2 | 29 | RC(7)-0 | RC(3)-5* | 47 | P-6 | P-6 |
| 12 | RC(4)-0 | RC(4)-0 | 30 | RC(8)-0 | R-5* | 48 | RC(9)-1 | RC(4)-7* |
| 13 | RC(3)-2 | RC(3)-2 | 31 | P-4 | P-4 | 49 | RC(5)-3 | RC(1)-8* |
| 14 | R-2 | R-2 | 32 | RC(4)-4 | RC(4)-4 | 50 | RC(6)-3 | RC(2)-8* |
| 15 | P-2 | P-2 | 33 | RC(5)-0 | RC(1)-5* | 51 | RC(7)-3 | RC(3)-8* |
| 16 | RC(4)-1 | RC(4)-1 | 34 | RC(6)-0 | RC(2)-5* | 52 | RC(9)-2 | RC(4)-8* |
| 17 | RC(1)-3 | RC(1)-3 | 35 | RC(7)-1 | RC(3)-6* | 53 | RC(8)-3 | R-8* |
| 18 | RC(2)-2 | RC(2)-2 | 36 | RC(10)-0 | RC(4)-5* | 54 | Synch. | Synch. |

In the above table:

P=pitch

R=RMS amplitude

RC=reflection coefficient

In each code, bit 0 is the least significant bit. (For example, RC(1)–0 is the least significant bit of reflection code 1.) An asterisk (*) in a given bit position of an unvoiced frame indicates that the bit is an error control bit.

Intermediate compressed voice signal 40 produced by framing and synchronization function 124 thus is a continuous series of 54 bit frames each of which contains hashed data describing parameters (e.g., amplitude, pitch, voicing, and resonance) of the portion of applied voice signal 15 to which the frame corresponds. The frames also include a degree of control information (synchronization alone for voiced frames, and, additionally, error control information for unvoiced frames). The frames of intermediate compressed voice signal 40 are produced in real time with respect to applied voice signal and, as discussed, are stored as a data file 52 in memory 50 (FIG. 1).

Figure 4:
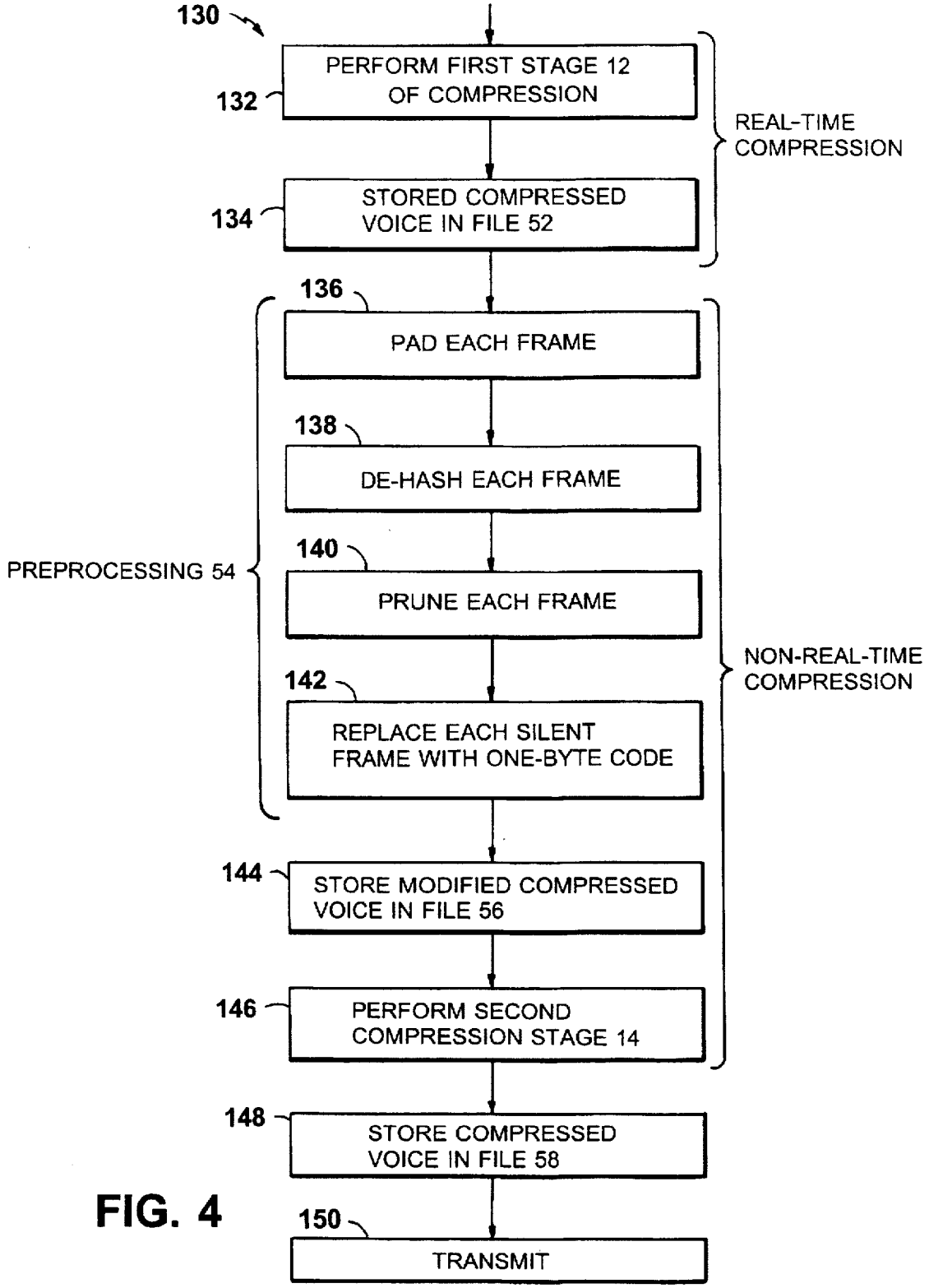
FIG. 4 shows the processing steps performed by the compression system of FIG. 1.

FIG. 4 is a flow chart showing the operation (130) of compression system 10. The first two steps, performing the first stage 12 of compression (132) and storing the intermediate compressed voice signal 40 in data file 52 (134) were described above. The next four steps are performed by preprocessor 54.

As discussed above, the frames produced by first compression stage 12 are 54 bits long, and thus have non-integer byte lengths. Data compression procedures, such as PKZIP performed by second compression stage 14 compress data based on redundancies that occur in the data stream. Thus, these procedures work most efficiently on data that have integer byte lengths. The first step (136) performed by preprocessor 54 is to "pad" each frame with two logic "0" bits (logic "1" values could be used instead) to cause each frame to have an integer (7) byte length of exactly 56 bits.

Next, preprocessor "dehashes" each frame (138). The hashing performed during first compression stage 12 inherently masks redundancies that occur from frame-to-frame in the various parameters of the voice information. The dehashing performed by preprocessor 54 rearranges the data in each frame so that the data for each voice parameter appears together in the frame. As rearranged, the data in each frame appears as shown in Table I above, with the exception that the 5 RMS amplitude bits appear first in the dehashed frame, followed by the pitch and voicing bits; the remainder of the frame appears in the order shown in Table I (the two pad bits occupy the least significant bits of the frame).

The error control bits, the synchronization bit, and of course the unused and pad bits of unvoiced frames contain no information about the parameters of the voice signal (and, as discussed above, the error control bits are formed from the RMS amplitude information and the first four reflection coefficients, and can thus be reconstructed at any time from this data). Thus, the next step performed by preprocessor 54 is to "prune" these bits from unvoiced frames (140). That is, the 20 error control bits, the synchronization bit, and the two pad bits are removed from each unvoiced frame (as discussed above, the one byte pitch and voicing data 106 in each frame indicates whether the frame is voiced or not). As a result, unvoiced frames are reduced in size (compressed) to 32 bits (4 bytes). Note that the integer byte length is maintained. Pruning (140) is not performed on voiced frames, because the reduction in frame size (by three bits) that would be obtained is relatively small and would result in voiced frames having non-integer byte lengths.

The final step performed by preprocessor 54 is silence gating (142). Each silent frame (be it a voiced frame or an unvoiced frame) is replaced in its entirety with a one byte (8 bit) code that uniquely identifies the frame as a silent frame. Applicant has found that 10000000 ($80_{HEX}$) is distinct from all codes used by LPC-10 for RMS amplitude (which all have a most significant bit=0), and thus is a suitable choice for the silence code. LPC-10 does not distinguish between silent and nonsilent frames—voicing data and reflection coefficients are produced for silent frames even though this information is not heard in the reconstructed analog voice signal. Thus, replacing silent frames with a small code dramatically decreases the amount of data that need be transmitted to decompression system 30 without loss of any meaningful voice information. Silence is detected based on the 5 bit RMS amplitude code of the frame. Frames whose RMS amplitude codes are 0 (i.e., 00000) are deemed to be silent. (Of course, another suitable code value may instead be used as the silence threshold, if desired.)

To summarize, the preprocessor 54 reduces the size of nonsilent, unvoiced frames from 54 bits to 32 bits (4 bytes), and replaces each 54 bit silent frame with an 8 bit (1 byte) code. Voiced frames that are not silent are slightly increased in size, to 56 bits (7 bytes). Preprocessor 54 stores the frames of modified, compressed voice signal 40' are stored (144) in data file 56 (FIG. 1).

Second stage 14 of compression is then performed on data file 56 to compress it further according to the dictionary encoding procedure implemented by PKZIP or any other suitable compression technique (146). Second compression stage 14 compresses data file 56 as it would any computer data file—the fact that data file 56 represents speech does not alter the compression procedure. Note, however, that steps 136–142 performed by preprocessor greatly increase the speed and efficiency with which second compression stage 14 operates. Applying integer-length frames to second compression stage 14 facilitates detecting regularities and redundancies that occur from frame to frame. Moreover, the decreased sizes of unvoiced and silent frames reduces the amount of data applied to, and thus the amount of compression needed to be performed by, second stage 14.

Output 42 of second compression stage 14 is stored in data file 58 (148) that is compressed to between 50% and 80% of the size of data file 56. Depending on such factors as the amount of silence in the applied voice signal 15 and the continuity and redundancy of the voice signal, the digitized voice signal represented by output 42 is compressed to between 1920 bps and 960 bps with respect to the applied voice signal 15.

CPU 11 then implements a telecommunications procedure (such as Z-modem) to transmit data file 58 over telephone lines 20 (150). CPU 11 also invokes a dialer (not shown) to call the receiving decompression system 30 (FIG. 1). When the connection with decompression system 30 has been established, the Z-modem procedure invokes the flow control and error detection and correction procedures that are normally performed when transmitting digital data over telephone lines, and passes data file 58 to modem 60 as a serial bit stream via an RS-232 port of CPU 11. Modem 60 transmits data file 60 over telephone line 20 at 24000 bps according to the V.42 bis protocol.

Figure 5:
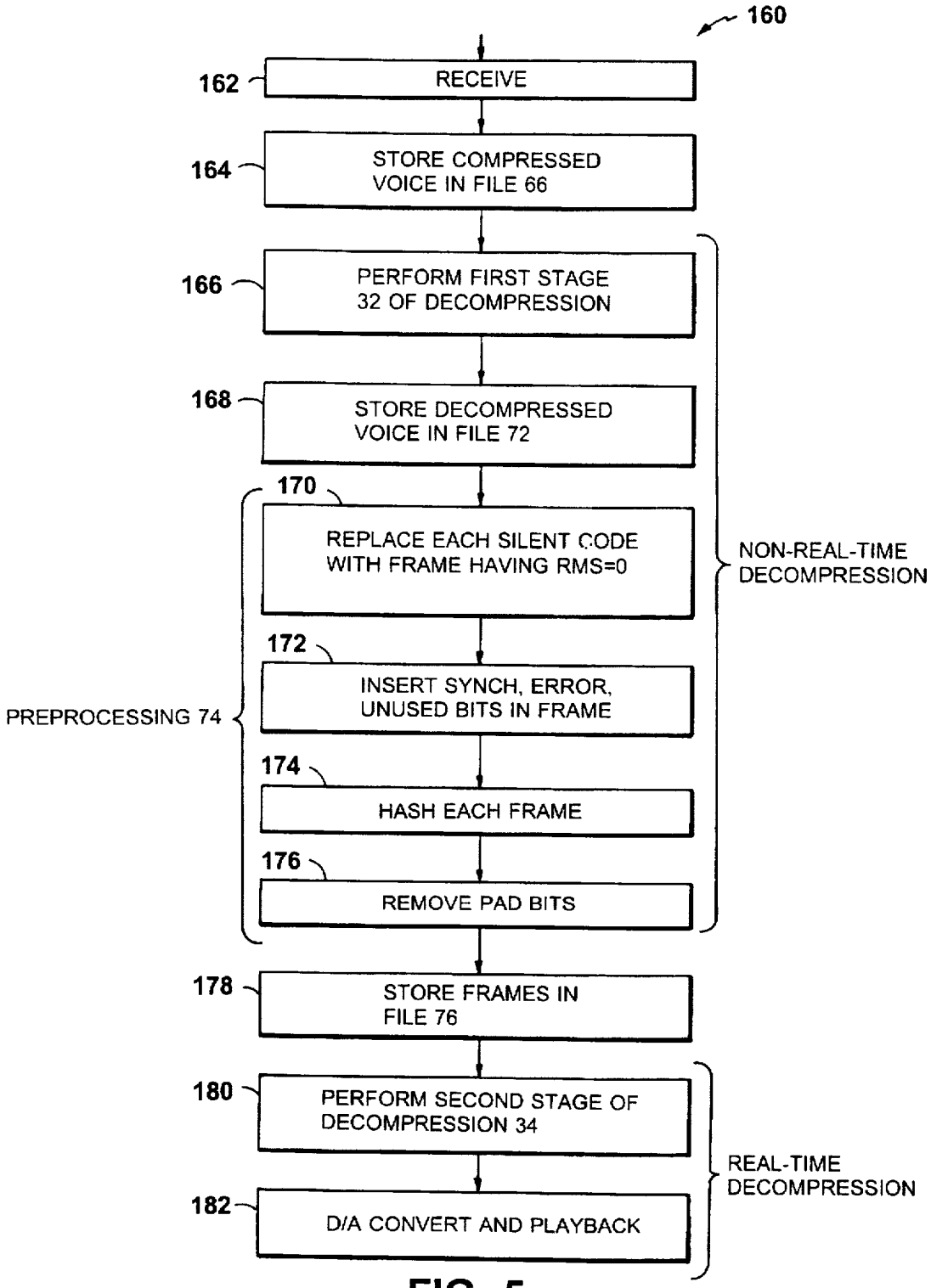
FIG. 5 shows the processing steps performed by the decompression system of FIG. 2.

FIG. 5 shows the processing steps (160) performed by decompression system 30. Modem 64 receives (162) the compressed voice signal from a telephone line, processes it according to the V.42 bis protocol, and passes the compressed voice signal to CPU 33 via an RS-232 port. CPU 33 implements a telecommunications package (such as Z-modem) to convert the serial bit stream from modem 64 into one byte (8 bit) words, performs standard error detection and correction and flow control, and stores the compressed voice signal as a data file 66 in memory 70 (164).

First stage 32 of decompression is then performed on data file 66 (166), and the resulting, time-expanded intermediate voice signal 44 is stored as a data file 72 in memory 70 (168). First decompression stage 32 is performed by CPU 33 using a lossless data decompression procedure (such as PKZIP). Other types of decompression techniques may be used instead, but note that the goal of first decompression stage 32 is to losslessly reverse the compression performed by second compression stage 14. The decompression results in data file 72 being expanded by 50% to 80% with respect to the size of data file 66.

The decompression performed by first stage 34 is, like the compression imposed by second compression stage 14, lossless. As a result, assuming that any errors that occur during transmission are corrected by modems 60, 64, data file 72 will be identical to data file 56 (FIG. 1). In addition, data file 72 consists of frames having nonhashed data with three possible configurations: (1) 7 byte, nonsilent voiced frames; (2) 4 byte, nonsilent unvoiced frames; and (3) 1 byte silence codes. Preprocessor 74 essentially "undoes" the preprocessing performed by preprocessor 54 (see FIG. 3) to provide second decompression stage 34 with frames having a uniform size (54 bits) and a format (i.e., hashed) that stage 34 expects.

First, preprocessor 74 detects each 1-byte silence code ($80_{HEX}$) in data file 72 and replaces it with a 54 bit frame that has a five bit RMS amplitude code of 00000 (170). The values of the remaining 49 bits of the frame are irrelevant, because the frame represents a period of silence in applied voice signal 15. The preprocessor 74 assigns these bits logic 0 values.

Next, preprocessor 74 recalculates the 20 bit error code for each unvoiced frame (recall that the value of the pitch and voicing word 106 in each frame indicates whether the frame is voiced or not) and adds it to the frame (172). As discussed above, according to the LPC-10 standard, the value of the error code is calculated based on the four most significant bits of the RMS amplitude code and the first four reflection coefficients [(RC(1)–RC(4)]. In addition, preprocessor 74 re-inserts the unused bit (see Table I) into each unvoiced frame. A single synchronization bit is also added to every voiced and unvoiced frame; the preprocessor alternates the value assigned to the synchronization bit between logic 0 and logic 1 for successive frames.

Preprocessor 74 then hashes the data in each frame in the manner discussed above and shown in Table II (174). Finally, preprocessor 74 strips the two pad bits from the frames (176), thereby returning each voiced and unvoiced frame to their original 54 bit length. The frames as modified by preprocessor 74 are stored in data file 76 (178). Neglecting the effects of transmission errors, the nonsilent voiced and unvoiced frames as modified by preprocessor 74 are identical to data file 76 and are identical to the frames as produced by first compression stage 12. (Although the pitch and voicing data (if any) and RC data possessed by the silent frames produced by first compression stage 12 are missing from the silent frames reconstructed by preprocessor 74, this information is not lost as a practical matter, because he portion of applied voice signal that this information represents is silent and thus is not heard when the applied voice signal is reconstructed.)

DSP 35 retrieves data file 76 and performs the second stage 34 of decompression on the data in real time to complete the decompression of the voice signal (180). D/A conversion is applied to the expanded, digitized voice signal 80, and the reconstructed analog voice signal 46 obtained thereby is played back for the user (182). The second decompression stage 34 is preferably implemented using the LPC-10 protocol discussed above, and essentially "undoes" the compression performed by first compression stage 12. Thus, details of the decompression will not be discussed. A functional block diagram of a typical LPC-10 decompression technique is shown in the federal standard discussed above.

Figure 6:
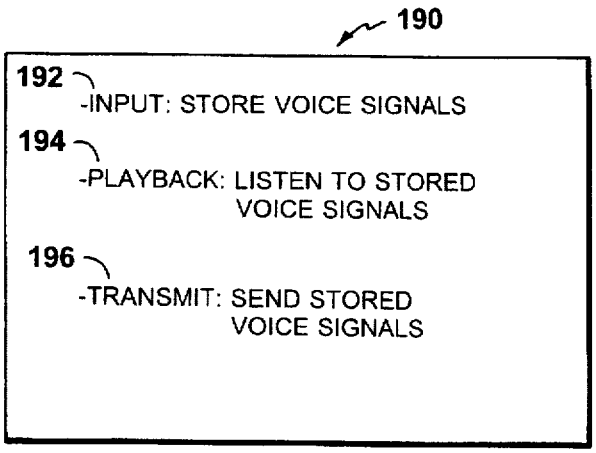
FIG. 6 illustrates different modes of operation of the compression system of FIG. 1.

Referring also to FIG. 6, the operation of compression system 10 is controlled via a user interface 62 to CPU 11 that includes a keyboard (or other input device, such as a mouse) and a display (not separately shown). System 10 has three basic modes of operation, which are displayed to the user in menu form 190 for selection via the keyboard. When the user chooses the "input" mode (menu selection 192), CPU 11 enables the DSP 13 to receive applied voice signals 15 as a "message," perform the first stage of compression 12, and store intermediate signals 40 that represent the message in data file 52. Preprocessing 54 and second stage of compression 14 are not performed at this time. The user is prompted to identify the message with a message name. CPU 11 links the name to the stored message for subsequent retrieval, as described below. Any number of messages (limited, of course, by available memory space) can be applied, compressed, and stored in memory 50 in this way.

The user can listen to the stored voice signals for verification at any time by selecting the "playback" mode (menu selection 194) and entering the name of the message to be played back. CPU 11 responds by retrieving the message from data file 52, and causing DSP 13 to decompress it according to the LPC-10 standard (i.e., using the same decompression procedure as that performed by decompression stage 34), reconstruct the spoken message by D/A conversion, and apply the message to a speaker. (The playback circuitry and speaker are not shown in FIG. 1.) The user can record over the message if desired, or may maintain the message as is in memory 50.

The user commands compression system 10 to transmit a stored message to decompression system 30 by entering the "transmit" mode (menu selection 196) and selecting the message (e.g., using the keyboard). The user also identifies the decompression system 30 that is to receive the compressed message (e.g., by typing in the telephone number of system 30 or by selecting system 30 from a displayed menu). CPU 11 retrieves the selected message from data file 52, applies preprocessing 54 and performs second stage 14 of decompression to fully compress the message, all in the manner described above. CPU 11 then initiates the call to decompression system 30 and invokes the telecommunications procedures discussed above to place the fully compressed message on telephone lines 20.

The operation of decompression system 30 is controlled via user interface 73, which provides the user with a menu (not shown) of operating modes. For example, the user may select any of the messages stored in data file 66 for listening. CPU 33 and DSP 35 respond by decompressing and reconstructing the selected message in the manner discussed above.

For maximum flexibility, each system 10, 30 may be configured to perform both the compression procedures and the decompression procedures described above. This enables users of systems 10, 30 to exchange highly compressed messages using the techniques of the invention.

Other embodiments are within the scope of the following claims.

For example, techniques other than LPC-10 may be used to perform the real-time, lossy type of compression. Alternatives include CELP (code excited linear prediction), SCT (sinusoidal transform coding), and multiband excitation (MBE). Moreover, alternative lossless compression techniques may be employed instead of PKZIP (e.g., Compress distributed by Unix Systems Laboratories. Also, while the detection of portions of the speech signal representing silence are described above, other repeated patterns could also be removed or removed instead of the silent portions.

Wireless communication links (such as radio transmission) may be used to transmit the compressed messages.

While the foregoing invention has been described with reference to its preferred embodiments, various alterations and modifications will occur to those skilled in the act. For example, the compression ratios described in this application will change if the modem throughout is changed. In addition, while the term "bps" might imply a fixed bit rate, it should be understood that since the invention described herein allows variable bit rates, the bit rates expressed above are "average" bit rates. All such alterations and modifications are intended to fall within the scope of the appended claims.

What is claimed is:

1. A method of voice compression comprising the steps of:

performing a first type of compression on a voice signal to produce an intermediate signal that is compressed with respect to the voice signal in accordance with a speech compression procedure;

storing the intermediate signal;

performing a second type of compression different from the first type on said stored intermediate signal to produce an output signal that is compressed with respect to the intermediate signal; and wherein said first type of compression is of a kind that causes loss of a portion of the information contained in the intermediate signal with respect to the voice signal, and said second type of compression is of a kind that causes no loss of information contained in the output signal with respect to the intermediate signal.

2. A method of voice compression comprising the steps of:

performing a first type of compression on a voice signal to produce an intermediate signal that is compressed with respect to the voice signal;

storing the intermediate signal;

performing a second type of compression different from the first type on said stored intermediate signal to produce an output signal that is compressed with respect to the intermediate signal; and wherein said output signal is compressed in time with respect to said voice signal.

3. A method of voice compression comprising the steps of:

performing a first type of compression on a voice signal to produce an intermediate signal that is compressed with respect to the voice signal in accordance with a speech compression procedure;

performing a second type of compression different from the first type on said intermediate signal to produce an output signal that is compressed with respect to the intermediate signal; and storing said intermediate signal as a data file prior to performing said second type of compression.

4. The method of claim 7 further comprising storing said output signal as a data file.

5. A method of voice compression comprising the steps of:

performing a first type of compression on a voice signal to produce an intermediate signal that is compressed with respect to the voice signal;

performing a second type of compression different from the first type on said intermediate signal to produce an output signal that is compressed with respect to the intermediate signal; and wherein said voice signal includes speech interspersed with silence, and said first type of compression produces said intermediate signal as a sequence of frames each of which corresponds in time to a portion of said voice signal and said voice signal includes data representative of said portion of said voice signal, and further comprising detecting at least one of said frames which corresponds to a portion of said voice signal that contains silence, replacing said at least one of said frames in said sequence with a binary code that indicates silence, and thereafter performing said second type of compression on said sequence.

6. The method of claim 5 wherein said frames have a selected minimum size, said code being smaller than said minimum size.

7. A method of voice compression comprising the steps of:

performing a first type of compression on a voice signal to produce an intermediate signal that is compressed with respect to the voice signal;

performing a second type of compression different from the first type on said intermediate signal to produce an output signal that is compressed with respect to the intermediate signal; and wherein said first type of compression produces said intermediate signal as a sequence of frames each of which corresponds in time to a portion of said voice signal and contains data that represents a plurality of characteristics of said voice signal, said data for at least one of said characteristics being interleaved with said date for at least one other of said characteristics in said frame, and further comprising:

deinterleaving said delta so that said data for each one of said characteristics appears together in said frame, and thereafter performing said second type of compression on said sequence.

8. The method of claim 7 wherein said one characteristic includes amplitude content and said other characteristic includes frequency content.

9. A method of voice compression comprising the steps of:

performing a first type of compression on a voice signal to produce an intermediate signal that is compressed with respect to the voice signal;

performing a second type of compression different from the first type on said intermediate signal to produce an output signal that is compressed with respect to the intermediate signal; add wherein said first type of compression produces said intermediate signal as a sequence of frames each of which corresponds in time to a portion of said voice signal and contains data that represents information contained in said portion of said voice signal and data that does not represent said information, and further comprising:

removing said data that does not represent said information from each one of said frames, and thereafter performing said second type of compression on said sequence.

10. A method of voice compression comprising the steps of:

performing a first type of compression on a voice signal to produce an intermediate signal that is compressed with respect to the voice signal;

performing a second type of compression different from the first type on said intermediate signal to produce an output signal that is compressed with respect to the intermediate signal; and wherein said first type of compression produces said intermediate signal as a sequence of frames each of which corresponds in time to a portion of said voice signal and includes a plurality of bits of data at least some of which represent information contained in said portion of said voice signal, each said frame being a non-interger number of bytes in length, and further comprising:

adding a selected number of bits to each said frame to increase the length thereof to an integer number of bytes, and thereafter performing said second type of compression on said sequence.

11. A method of performing compression on a voice signal that includes redundant signal information, comprising the steps of:

performing compression on a voice signal to produce a first compressed signal;

detecting at least one portion of said compressed signal that corresponds to a portion of said voice signal that contains only said redundant signal information;

replacing said at least one portion of said first compressed signal with a binary code that indicates said redundant signal information.

12. The method of claim 11 wherein said compression produces said compressed signal as a sequence of frames each of which corresponds to a portion of said voice signal and includes data representative of said portion of said voice signal, and further comprising the steps of:

detecting at least one of said frames which corresponds to said portion of said voice signal that contains only said redundant signal information, and replacing said at least one of said frames in said sequence with said binary code.

13. The method of claim 11 further comprising performing a second, different type of compression on said first compressed signal to produce a second compressed signal that is compressed with respect to said first compressed signal.

14. The method of claim 11 wherein said step of detecting includes determining that a magnitude of said first compressed signal that corresponds to a level of said voice signal is less than a threshold.

15. The method of claim 11 further comprising the steps of:

detecting said code in said first compressed signal, and replacing said code with a period of sound or silence represented by said redundant signal information of a selected length, and thereafter performing decompression of said compressed signal to produce a second voice signal that is expanded with respect to said compressed signal and that is a recognizable reconstruction of the voice signal prior to compression.

16. The method of claim 11 wherein said redundant signal information represents silence.

17. Voice compression apparatus comprising:

a first compressor for performing a first type of compression on a voice signal to produce an intermediate signal that is a signal in accordance with a speech compression procedure;

a memory for storing the intermediate signal;

a second compressor for performing a second type of compression different from the first type on the stored intermediate signal to produce an output signal that is compressed with respect to the intermediate signal; and wherein said first compressor causes loss of a portion of the information contained in the intermediate signal with respect to the voice signal, and said second compressor causes no loss of information contained in the output signal with respect to the intermediate signal.

18. Voice compression apparatus comprising:

a first compressor for performing a first type of compression on a voice signal to produce an intermediate signal that is a signal in accordance with a speech compression procedure;

a second compressor for performing a second type of compression different from the first type on the intermediate signal to produce an output signal that is compressed with respect to the intermediate signal; and a memory for storing said intermediate signal as a data file.

19. The apparatus of claim 18 further comprising a memory for storing said output signal as a data file.

20. Voice compression apparatus comprising:

a first compressor for performing a first type of compression on a voice signal to produce an intermediate signal that is a signal;

a second compressor for performing a second type of compression different from the first type on the intermediate signal to produce an output signal that is compressed with respect to the intermediate signal; and wherein said voice signal includes speech interspersed with silence, and said first compressor produces said intermediate signal as a sequence of frames each of which corresponds in time to a portion said voice signal and includes data representative of said portion of said voice signal, and further comprising:

a detector for detecting at least one of said frames which corresponds to a portion of said voice signal that contains substantially only silence, means for replacing said at least one of said frames in said sequence with a binary code that indicates silence, and means for thereafter applying said sequence to said second compressor.

21. The apparatus of claim 20 wherein said frames have a selected minimum size, said code being smaller than said minimum size.

22. Voice compression apparatus comprising;

a first compressor for performing a first type of compression on a voice signal to produce an intermediate signal that is a signal;

a second compressor for performing a second type of compression on the intermediate signal different from the first type to produce an output signal that is compressed with respect to the intermediate signal; and wherein said first compressor produces said intermediate signal as a sequence of frames each of which corresponds to a portion of said voice signal and contains data that represents a plurality of characteristics of said voice signal, said data for at least one of said characteristics being interleaved with said data for at least one other of said characteristics in said frame, and further comprising:

means for deinterleaving said data so that said data for each one of said characteristics appears together in said frame, and means for thereafter applying said sequence to said second compressor.

23. The apparatus of claim 22 wherein said one characteristic includes amplitude content and said other characteristic includes frequency content.

24. Voice compression apparatus comprising;

a first compressor for performing a first type of compression on a voice signal to produce an intermediate signal that is a signal;

a second compressor for performing a second type of compression different from the first type on the intermediate signal to produce an output signal that is compressed with respect to the intermediate signal; and wherein said first compressor produces said intermediate signal as a sequence of frames each of which corresponds to a portion of said voice signal and contains data that represents information contained in said portion of said voice signal and data that does not represent said information, and further comprising:

means for removing said data that does not represent said information from each one of said frames, and means for thereafter applying said sequence to said second compressor.

25. Voice compression apparatus comprising:

a first compressor for performing a first type of compression on a voice signal to produce an intermediate signal that is a signal;

a second compressor for performing a second type of compression different from the first type on the intermediate signal to produce an output signal that is compressed with respect to the intermediate signal; and wherein said first compressor produces said intermediate signal as a sequence of frames each of which corresponds to a portion of said voice signal and includes a plurality of bits of data at least some of which represent information contained in said portion of said voice signal, each said frame being a non-integer number of bytes in length, and further comprising:

circuitry for adding a selected number of bits to each said frame to increase the length thereof to an integer number of bytes, and means for thereafter applying said sequence to said second compressor.

26. Apparatus for performing compression on a voice signal that includes speech interspersed with redundant signal information, comprising:

a compressor for performing compression on a voice signal to produce a first compressed signal that is compressed with respect to the voice signal, a detector for detecting at least one portion of said first compressed signal that corresponds to a portion of said voice signal that contains substantially only said redundant signal information, means for replacing said at least one portion of said first compressed signal with a binary code that indicates said redundant signal information.

27. The apparatus of claim 26 wherein said compressor produces said compressed signal as a sequence of frames each of which corresponds to a portion of said voice signal and includes data representative of said portion of said voice signal, said detector detecting at least one of said frames which corresponds to said portion of said voice signal that contains substantially only said redundant signal information, and said means for replacing substituting said at least one of said frames in said sequence with said binary code.

28. The apparatus of claim 26 further comprising a second compressor for performing a second, different type of compression on said first compressed signal to produce a second compressed signal that is compressed with respect to said first compressed signal.

29. The apparatus of claim 26 wherein said detector includes means for determining that a magnitude of said first compressed signal that corresponds to a level of said voice signal is less than a threshold.

30. The apparatus of claim 26 further comprising:

a second detector for detecting said binary code in said first compressed signal and replacing said code with a period of sound or silence represented by said redundant signal information of a selected length, and a decompressor for performing decompression of said first compressed signal to produce a second voice signal that is expanded with respect to said compressed signal and that is a recognizable reconstruction of the voice signal prior to compression.

31. The apparatus of claim 26 wherein said redundant signal information represents silence.

* * * * *

UNITED STATES PATENT AND TRADEMARK OFFICE

CERTIFICATE OF CORRECTION

PATENT NO. : 5,742,930

DATED : April 21, 1998

INVENTOR(S) : Andrew Wilson Howitt

It is certified that error appears in the above-identified patent and that said Letters Patent is hereby corrected as shown below:

On the cover of the patent, in the [56] References Cited Section, Other Publications section, in the "Bindley" reference, "issuies" should be --issues--.

Col. 1, line 4, "08/168/815" should be --08/168,815--.

Col. 1, line 43, before "LPC-10" start a new paragraph.

Col. 6, line 32, "intermediate" should be --Intermediate--.

Col. 12, line 20, "he" should be --the--.

Col. 14, claim 3, lines 17-18, delete "in accordance with a speech compression procedure".

Col. 15, claim 7, line 3, "delta" should be --data--

Col. 15, claim 8, line 8, "7" should be --5--.

Col. 15, claim 9, line 19, "add" should be --and--.

Col. 16, claim 17, line 38, delete "stored".

Signed and Sealed this

Fourteenth Day of July, 1998

Bruce Lehman

*Attest:*

BRUCE LEHMAN

*Attesting Officer*

*Commissioner of Patents and Trademarks*